US005456982A

United States Patent [19]

Hansen et al.

[11] Patent Number: 5,456,982

[45] Date of Patent: Oct. 10, 1995

[54] BICOMPONENT SYNTHESIS FIBRE AND PROCESS FOR PRODUCING SAME

[75] Inventors: Anders S. Hansen, Oksbøl; Bjørn Marcher, Gentofte; Peter Schloss, Frederiksberg, all of Denmark

[73] Assignee: Danaklon A/S, Varde, Denmark

[21] Appl. No.: 38,077

[22] Filed: Mar. 29, 1993

Related U.S. Application Data

[63] Continuation of Ser. No. 601,691, filed as PCTDK89/00/02 May 2, 1989, abandoned.

[30] Foreign Application Priority Data

May 5, 1988 [DK] Denmark ..... 2454/88

[51] Int. Cl.[6] ..... B32B 9/00; B32B 27/00; D02G 3/00; B29C 41/22

[52] U.S. Cl. ..... 428/370; 428/373; 428/374; 428/296; 428/394; 428/395; 428/396; 428/397; 428/401; 264/78; 264/148; 264/168; 264/210.8; 264/211; 264/172.15

[58] Field of Search ..... 428/370, 373, 428/374, 392, 394, 395, 396, 397, 401; 264/78, 148, 168, 171, 210.8, 211

[56] References Cited

U.S. PATENT DOCUMENTS

| | | | |
|---|---|---|---|
| 3,584,339 | 7/1969 | Kamachi et al. | 18/8 |
| 4,189,338 | 2/1980 | Ejima et al. | 428/370 |
| 4,234,655 | 11/1980 | Kunimune et al. | 428/296 |
| 4,269,888 | 5/1981 | Ejima et al. | 428/370 |
| 4,425,126 | 1/1984 | Butterworth et al. | 428/296 |
| 4,458,042 | 7/1984 | Espy | 428/284 |
| 4,477,516 | 10/1984 | Sugihara et al. | 428/296 |
| 4,578,414 | 3/1986 | Sawyer et al. | 524/375 |
| 4,622,089 | 11/1986 | Lauritzen | 156/289 |
| 4,655,877 | 4/1987 | Horimoto et al. | 428/296 |
| 4,732,809 | 3/1988 | Harris, Jr. et al. . | |
| 5,231,122 | 7/1993 | Palumbo et al. | 524/30 |

FOREIGN PATENT DOCUMENTS

| | | |
|---|---|---|
| 0248598 | 12/1987 | European Pat. Off. . |
| 0260607 | 3/1988 | European Pat. Off. . |
| 0093021 | 12/1988 | European Pat. Off. . |
| 0132110 | 8/1989 | European Pat. Off. . |
| 0337296 | 10/1989 | European Pat. Off. . |
| 50-40169 | 12/1975 | Japan . |
| 77703 | 11/1977 | Japan . |
| 55-84420 | 6/1980 | Japan . |
| 43118 | 3/1984 | Japan . |
| 62-250278 | 10/1987 | Japan . |
| 63-92723 | 3/1988 | Japan . |
| 48-15684 | 5/1993 | Japan . |
| 4813169 | 8/1993 | Japan . |

(List continued on next page.)

OTHER PUBLICATIONS

Polypropylene Fibers Science and Technology, By M. Ahmed, Elsevier Scientific Publ. Co., 1982, pp. 329–346.

Folks, Short Fibre Reinforced Thermoplastics, Research Studies Press, 1982 p. 83.

Encyclopedia of Polymer Science and Technology, vol. 6, 1986 pp. 830–831.

F. O. Harris, Tappi Nonwovens Seminar, pp. 71–73, 25 Jun. 1990.

Fundamentals of Fibre Formation, pp. 366–373 (1976).

*Primary Examiner*—George F. Lesmes
*Assistant Examiner*—Kathryne E. Shelborne
*Attorney, Agent, or Firm*—Birch, Stewart, Kolasch & Birch

[57] ABSTRACT

A thermobondable bicomponent synthetic fiber (8,14) with a length of at least about 3 mm, adapted to use in the blending of fluff pulp for the production of hygiene absorbent products, the fiber comprising an inner core component comprises a polyolefin or a polyester, the sheath component comprises a polyolefin, and the core component has a higher melting point than the sheath component, and a process for producing said fiber. The sheath-and-core type fiber is preferably made permanently substantially hydrophilic by incorporating s surface active agent into the sheath component. The long bicomponent fibers (20) form a strong supporting three-dimensional matrix structure (20,24) in the absorbent product upon thermobonding.

40 Claims, 1 Drawing Sheet

FOREIGN PATENT DOCUMENTS

| | | |
|---|---|---|
| 165251 | 10/1990 | Norway . |
| 431996 | 4/1978 | Sweden . |
| 1367577 | 9/1974 | United Kingdom . |
| 2096048 | 10/1982 | United Kingdom . |
| 2180543 | 9/1985 | United Kingdom . |

BICOMPONENT SYNTHESIS FIBRE AND PROCESS FOR PRODUCING SAME

This application is a continuation, of application Ser. No. 07/601,691 filed on filed as PCT/DK89/00/02 May 2, 1989, now abandoned.

BACKGROUND OF THE INVENTION

The present invention relates to a thermobondable, hydrophilic bicomponent synthetic fiber for use in the blending of fluff pulp, and to a process for producing the fiber. More specifically, the invention relates to a fiber comprising an outer sheath component and an inner core component, the core component having a higher melting point than the sheath component. The fiber is permanently substantially hydrophilic. The term "hydrophilic" refers to the fact that the fiber has an affinity for water, and thus is easily dispersed in water or aqueous mixtures. This affinity may be ascribed to the presence of polar groups on the fiber's surface. The term "permanently" substantially hydrophilic refers to the fact that the fiber will retain its hydrophilic properties after repeated dispersions in water. This is obtained by incorporating a surface active agent and optionally a hydrophilic polymer or copolymer into the sheath component of the fiber. The fiber of the present invention is useful in the preparation of "fluff", which is a fluffy fibrous material used as an absorbent and/or liquid-conducting core in the production of hygiene absorbent products such as disposable diapers. Fluff is produced by defibrating and dry forming so-called "fluff pulp", which is comprised of natural and/or synthetic fibers.

There has been a trend in recent years towards stronger, thinner and lighter weight disposable diapers, and other disposable hygiene absorbent products. One factor in this trend has been the development of a number of synthetic fibers, notably heat-adhesive (thermobondable) synthetic fibers, which have been used to replace at least some of the natural cellulose fibers in these products. Such thermobondable synthetic fibers are typically used to bond the cellulose fibers together, thereby achieving an absorbent material with improved strength and allowing the production of thinner and lighter weight products. Examples of patents describing such fibers, or their use or production, are U.S. Pat. Nos. 4,189,338 (non-woven fabric comprising side-by-side bicomponent fibers), 4,234,655 (heat-adhesive composite fibers), 4,269,888 (heat-adhesive composite fibers), 4,425,126 (fibrous material using thermoplastic synthetic fibers), 4,458,042 (absorbent material containing polyolefin pulp treated with a wetting agent) and 4,655,877 (absorbent web structure containing short hydrophilic thermoplastic fibers), and European patent application No. 0 248 598 (polyolefin-type nonwoven fabric).

However, the use of these synthetic fibers in absorbent products has not been without problems. One problem which may be encountered is that it can be difficult to distribute the synthetic fibers into fluff pulp produced by a wet process, since these synthetic fibers are generally of a hydrophobic nature. Such hydrophobic fibers repel water, and therefore have a tendency to form conglomerations in the fluff pulp or to float at the surface of the wet fluff pulp if they are lighter than water. If the synthetic fibers are also distributed unevenly in the fluff, than barriers which hinder the transport of moisture may be created in the absorbent product, due to the fusion of the thermobonded fibers to each other in areas where there is a conglomeration of such fibers. Furthermore, the synthetic fibers currently used in the production of fluff are generally quite short, i.e. normally shorter than the cellulose fibers which typically comprise a substantial portion of the fluff. The supporting structure of the absorbent material is therefore formed by the cellulose fibers in the material, and since absorbent cores of such natural cellulose fibers have a tendency to break under the stress and bending to which, for example, diapers are subjected, wicking barriers are easily formed. Absorbent cores which consist only of natural cellulose fibers, i.e. which do not contain any synthetic fibers, may likewise also be subject to breakage and formation of wicking barriers due to stress and bending.

Hygiene absorbent products often include a so-called super absorbent polymer, in the form of a powder or small particles, which is incorporated into the material in order to achieve a weight reduction. However, the super absorbent polymer in these materials often has a tendency to sift out of the position in which it was originally placed, due to the lack of a structure which can effectively retain the small particles.

The long bicomponent synthetic fiber of the present invention addresses the problems mentioned above. The bicomponent fibers of the present invention are substantially longer than other fibers typically used in the preparation of fluff. During the production of absorbent products from fluff containing the bicomponent fiber, the fluff is subjected to a heat treatment (thermobonding), in which the sheath component of the bicomponent fiber is melted, while the high melting core component of the fiber remains intact. The core component of the long bicomponent fibers are thus fused together by the melting of the sheath component, forming a strong uniform supporting three-dimensional matrix in the absorbent material. The absorbent material is thus able to withstand flexing without developing wicking barriers due to breakage of the absorbent core. In addition, the matrix structure formed by the bicomponent fibers gives the material improved shape retention under dynamic stress during use of the absorbent product.

The three-dimensional mesh-like structure formed by the high melting component of the bicomponent fibers in the thermobonded material enables the super absorbent polymer to be held in the desired position. This is a further advantage, giving a more efficient use of the super absorbent polymer and helping to increase porosity, as well as giving the possibility of producing lighter weight absorbent materials.

In addition, the low melting sheath component has been made permanently substantially hydrophilic, thus allowing the fibers to be distributed homogeneously in the wet-processed fluff pulp which is typically used in the preparation of absorbent material. It is also desirable that the fibers in the finished product are hydrophilic, so that the product's absorbent and liquid-conducting properties are not impaired, as may be the case in a product with a substantial content of hydrophobic fibers.

DETAILED DESCRIPTION OF THE INVENTION

The present invention relates to a thermobondable, hydrophilic bicomponent synthetic fiber for use in the blending of fluff pulp, comprising an inner core component and an outer sheath components in which the core component comprises a polyolefin or a polyester, the sheath component comprises a polyolefin, and the core component has a higher melting point that the sheath component, the fiber being permanently substantially hydrophilic due to the incorporation into the sheath component of a surface active agent, e.g. a fatty acid ester of glycerol, a fatty acid amide, a polyglycol ester, a polyethoxylated amide, a nonionic surfactant, a cationic surfactant, or a blend of the above and/or other compounds normally used as emulsifiers, surfactants or detergents, the fiber having a length of 3–24 mm.

In a sheath-and-core type bicomponent fiber, the core component is surrounded by the sheath component, as opposed to a side-by-side or bilateral type bicomponent fiber, in which the two components both have a continuous longitudinal external surface. However, a small portion of the core component may be exposed at the surface in the case of a so-called "acentric" sheath-and-core fiber, as explained below.

The sheath component of the bicomponent fiber is selected from the group of polyolefins, while the core component may comprise a polyolefin or a polyester. The core component typically has a melting point of at least about 150° C., preferably at least about 160° C., and the sheath component typically has a melting point of about 140° C. or lower, preferably about 135° C. or lower. The two components of the fiber thus have melting points which are significantly different from each other, allowing the low melting sheath component to be melted in a thermobonding process, while the high melting core component remains substantially intact. While specific melting points are named in the following, it must be kept in mind that these materials, as all crystalline polymeric materials, in reality melt gradually over a range of a few degrees. However, this is not a problem, because the two components of the fiber will in practice be chosen such that their melting points are substantially different from each other.

Preferably, the fiber includes a sheath component comprising a low melting polyolefin such as high density polyethylene (melting point (m.p.) about 130° C.), low density polyethylene (m.p. about 110° C.), linear low density polyethylene (m.p. about 125° C.), or poly(1-butene) (m.p. about 130° C.), or mixtures or copolymers of the above, together with a core component comprising a polyolefin such as polypropylene (m.p. about 160° C.). The sheath component can furthermore comprise an ethylene-propylene copolymer based on propylene with up to about 7% ethylene (m.p. about 145° C.).

The fiber according to the present invention may also include a core component comprising poly(4-methyl-1-pentene) (m.p. about 230° C.), and a sheath component comprising any of the above mentioned polyolefins (i.e. high density polyethylene, low density polyethylene, linear low density polyethylene, poly(1-butene) or polypropylene).

Alternatively, the core component may comprise a polyester with a high melting point (i.e. above about 210° C.), such as poly(ethylene-terephtalate) (m.p. about 255° C.), poly(butylene-terephtalate) (m.p. about 230° C.), or poly(1,4-cyclohexylene-dimethylene-terephtalate) (m.p. about 290° C.), or other polyesters, or copolyesters comprising the above-mentioned structures and/or other polyesters. If the fiber includes a polyester core, the sheath may comprise any of the materials mentioned earlier (e.g. high density polyethylene, low density polyethylene, linear low density polyethylene, poly(1-butene), polypropylene, or copolymers or mixtures of these materials), or another material with a melting point of about 170° C. or lower.

In addition, the sheath component may comprise a mixture of, for example, low density polyethylene and either an (ethyl vinyl acetate) copolymer or an (ethylene acrylic acid) copolymer (m.p. about 100° C.), as explained below.

The composition of the two components of the fiber can thus be varied to include a number of different basic materials, and the exact composition in each case will obviously depend on the material in which the fiber is to be used, as well as the equipment and production processes used to prepare the absorbent material in question.

The fiber has been given permanent hydrophilic surface properties by incorporating a surface active agent into the sheath component and optionally by including a hydrophilic polymer or copolymer in the sheath component.

The surface active agent may typically be chosen from compounds normally used as emulsifiers, surfactants or detergents, and may comprise blends of these compounds. Examples of such compounds are fatty acid esters of glycerol, fatty acid amides, polyglycol esters, polyethoxylated amides, nonionic surfactants and cationic surfactants.

Specific examples of such compounds are a polyethylene glycol-lauryl ether, which has the formula:

$$CH_3(CH_2)_{11}\text{-O-}(CH_2CH_2O)_n\text{-H}$$

glycerol monostearate, which has the formula:

$$(C_{17}H_{35})COOCH_2CHOHCH_2OH$$

erucamide, which has the formula:

$$C_{21}H_{41}CONH_2$$

stearic acid amide, which has the formula:

$$CH_3(CH_2)_{16}CONH_2$$

a trialkyl-phosphate, which has the formula:

$$RO-\overset{\overset{\displaystyle O}{\|}}{\underset{\underset{\displaystyle OR}{|}}{P}}-OR, \quad R = C_nH_{2n+1}$$

alkyl-phosphate-amine ester, which has the formula:

$$CH_3(CH_2)_{11}-O-\overset{\overset{\displaystyle O}{\|}}{\underset{\underset{\displaystyle OCH_2CH_2NH_2}{|}}{P}}-O-(CH_2)_{11}CH_3$$

a lauryl phosphate-potassium salt, which has the formula:

$$CH_3(CH_2)_{11}-O-\overset{\overset{\displaystyle O}{\|}}{\underset{\underset{\displaystyle O^-K^+}{|}}{P}}-O-(CH_2)_{11}CH_3$$

or:

$$CH_3(CH_2)_{11}-O-\overset{\overset{\displaystyle O}{\|}}{\underset{\underset{\displaystyle OH}{|}}{P}}-O^-K^+$$

and an ethylenediamine-polyethylene glycol, which has the formula:

$$\begin{array}{l} CH_2N((CH_2CH_2O)_nH)_2 \\ | \\ CH_2N((CH_2CH_2O)_nH)_2 \end{array}$$

The compounds should preferably have a hydrophobic part to make them compatible with the olefinic polymer, and a hydrophilic part to make the surface of the fiber wettable. Blends of compounds can be used to control the hydrophilic properties. The surface active agent is typically incorporated into the sheath component in an amount of about 0.1–5%, and preferably about 0.5–2%, based on the total weight of the fiber. This amount of surface active agent is sufficient to give the fiber the desired hydrophilicity, without having any adverse effects on other properties of the fiber.

The sheath component may additionally comprise a hydrophilic polymer or hydrophilic copolymer. Examples of such a hydrophilic copolymer are (ethyl vinyl acetate) copolymer and (ethylene acrylic acid) copolymer. In this case, the sheath component may comprise, in addition to the surface active agent as described above, a mixture of, for example, about 50–75% low density polyethylene and about 50-25% of the hydrophilic copolymer, and the amount of vinyl acetate or acrylic acid, respectively, will typically be about 0.1–5%, and preferably about 0.5–2%, based on the total weight of the fiber.

The fibers can be nested for hydrophilicity by, for example, measuring the time required for them to sink in water. e.g. according to European Disposable Non-woven Association standard No. 10.1-72. The fibers may be placed in a metal net on the surface of the water, and they may be defined as being hydrophilic if they sink below the surface within about 10 seconds, and preferably within about 5 seconds.

The weight ratio of the sheath and core components in the bicomponent fiber is preferably in the range of about 10:90 to 90:10. If the sheath component comprises less than about 10% of the total weight of the fiber, it may be difficult to achieve sufficient thermobonding of the core component to other fibers in the material. Likewise, if the core component comprises less than about 10% of the total weight of the fiber, it may not be possible for the thermobonded core component to lend sufficient strength to the finished product. More specifically, the weight ratio of the sheath and core components will typically be from about 30:70 to 70:30, and preferably from about 40:60 to 65:35.

The cross section of the bicomponent fiber is preferably circular, since the equipment typically used in the production of bicomponent synthetic fibers normally produces fibers with a substantially circular cross section. However, the cross section may also be oval or irregular. The configuration of the sheath and core components can be either concentric or acentric (as illustrated in FIG. 1), the latter configuration sometimes being known as a "modified side-by-side" or an "eccentric" bicomponent fiber. The concentric configuration is characterized by the sheath component having a substantially uniform thickness, such that the core component lies approximately in the center of the fiber. In the acentric configuration, the thickness of the sheath component varies, and the core component therefore does not lie in the center of the fiber. In either case, the core component is substantially surrounded by the sheath component. However, in an acentric bicomponent fiber, a portion of the core component may be exposed, such that in practice up to about 20% of the surface of the fiber may be comprised of the core component. The sheath component in a fiber with an acentric configuration will nevertheless comprise the major part of the surface of the fiber, i.e. at least about 80%. Both the cross section of the fiber and the configuration of the components will depend upon the equipment which is used in the preparation of the fiber, the process conditions and the molecular weights of the two components.

The fibers preferably have a fineness of about 1–7 decitex (dtex) one decitex being the weight in grams of 10 km of fiber. The length of the fibers must be taken into consideration when choosing the fineness of such fibers, and since, as explained below, the bicomponent fibers of :he present invention are relatively long, the fineness should be set accordingly. The fibers will thus typically have a fineness of about 1.5–5 dtex, preferably about 1.7–3.3 dtex, and more preferably about 1.7–2.2 dtex. When more than one type of such fibers are used in the same fluff material, e.g. fibers of different length, the dtex/length ratio of the individual types of fibers may be constant or variable.

The fibers are preferably crimped, i.e. given a wavy form, in order to make them easier to process when preparing the fluff pulp. Typically, they will have about 0 to 10 crimps/cm, and preferably from about 0 to 4 crimps/cm.

The length of the bicomponent synthetic fibers of the present invention is significant, since they are..substantially longer than other fibers which are typically used in the preparation of fluff. For example, natural cellulose pulp fibers, which are typically the major component in fluff, are not normally more than about 3 mm long. The thermobondable synthetic fibers currently used in the preparation of fluff are typically shorter than cellulose fibers, and the cellulose fibers therefore make up the basic structure of the material. The bicomponent synthetic fibers of the current invention are, however, substantially longer than, for example, cellulose fibers. Therefore, the high melting core component of the bicomponent fibers makes up the basic structure of the thermobonded absorbent material, giving it improved characteristics with respect to strength and dimensional stability.

The fibers of the present invention are thus typically cut to a length of 5–20 mm, preferably 6–18 mm. Specially preferred lengths are about 6 mm and about 12 mm. The desired length is chosen according to the equipment to be used in the production of the absorbent material, as well as the nature of the material itself. While being relatively long, the fibers are nevertheless able to pass substantially intact through the grid holes in the hammer mills which are used in the production of fluff, since these holes typically have a diameter of about 10–18 mm, as will be described below.

The fibers may be prepared using a process comprising the following steps:

melting the constituents of the core and sheath components, incorporating a surface active agent, e.g. a fatty acid ester of glycerol, a fatty acid amide, a polyglycol ester, a polyethoxylated amide, a nonionic surfactant, a cationic surfactant, or a blend of the above and/or other compounds normally used as emulsifiers, surfactants or detergents, into the sheath component, spinning the low melting sheath component and the high melting core component into a spun bundle of bicomponent filaments, stretching the bundle of filaments, preferably, crimping the fibers, drying and fixing the fibers, and cutting the fibers to a length of 3–24 mm.

The above steps will be described in greater detail as follows:

The constituents of the sheath and core components, respectively, are melted in separate extruders (one extruder for each of the two components), which mix the respective components such that the melts have a uniform consistency and temperature prior to spinning. The temperatures of the melted components in the extruders are well above their respective melting points, typically more than about 90° C. above the melting points, thus assuring that the melts have flow properties which are appropriate for the subsequent spinning of the fibers.

To the melted sheath component is added the surface active agent in an appropriate amount based on the total weight of the spun fibers, as explained above. Additionally, as explained above, the sheath component may include a hydrophilic polymer or copolymer. The surface active agent and the optional hydrophilic polymer or copolymer is important for the production of wet-processed fluff pulp, since, as explained above, it is necessary that the surface of the bicomponent synthetic fibers be made substantially hydrophilic, so that they may be distributed homogeneously in the fluff pulp. It is possible to treat the surface of the spun fibers with a wetting agent, but the result is not necessarily permanent, and thus there may be a risk that the desired hydrophilic surface properties will be lost during the production of the absorbent material. By incorporating the surface active agent and the optional hydrophilic polymer or copolymer into the sheath component before spinning, the spun fiber is made permanently substantially hydrophilic, thus assuring that the desired homogeneous distribution of the bicomponent fibers in the fluff pulp can be obtained and that the functioning of the absorbent product will not be impaired by the presence of hydrophobic fibers.

The melted components are typically filtered prior to spinning, e.g. using a metal net, to remove any unmelted or cross-linked substances which may be present. The spinning of the fibers is typically accomplished using conventional melt spinning (also known as "long spinning"), in particular medium-speed conventional spinning, but so-called "short spinning" or "compact spinning" may also be employed (Ahmed, M., *Polypropylene Fibers-Science and Technology*, 1982). Conventional spinning involves a two-step process, in which the first step is the extrusion of the melts and the actual spinning of the fibers, while the second step is the stretching of the spun ("as-spun") fibers. Short spinning is a one-step process, in which the fibers are both spun and stretched in a single operation.

The melted sheath and core components, as obtained above, are led from their respective extruders, through a distribution system, and passed through the holes in a spinnerette. Producing bicomponent fibers is more complicated than producing monocomponent fibers, because the two components must be appropriately distributed to the holes. Therefore, in the case of bicomponent fibers, a special type of spinnerette is used to distribute the respective components, for example a spinnerette based on the principles described in U.S. Pat. No. 3,584,339. The diameter of the holes in the spinnerette is typically about 0.4–1.2 mm, depending on the fineness of the fibers being produced. The extruded melts are then led through a quenching duct, where they are cooled by a stream of air, and at the same time dream into bicomponent filaments, which are gathered into bundles of filaments. The bundles typically contain at least about 100 filaments, and more typically at least about 700 filaments. The spinning speed after the quenching duct is typically at least about 200 m/min, and more typically about 500–2000 m/min.

The bundles of filaments are subsequently stretched, preferably using so-called off-line stretching or off-line drawing, which, as mentioned above, takes place separately from the spinning process. Stretching is typically accomplished using a series of hot rollers and a hot air oven, in which a number of bundles of filaments are stretched simultaneously. The bundles of filaments pass first through one set of rollers, followed by passage through a hot air oven, and then passage through a second set of rollers. The hot rollers typically have a temperature of about 70°–130° C., and the hot air oven typically has a temperature of about 80°–140° C. The speed of the second set of rollers is faster than the speed of the first set, and the heated bundles of filaments are therefore stretched according to the ratio between the two speeds (called the stretch ratio or draw ratio). A second oven and a third set of rollers can also be used (two-stage stretching), with the third set of rollers having a higher speed than the second set. In this case the stretch ratio is the ratio between the speed of the last and the first set of rollers. Similarly, additional sets of rollers and ovens may be used. The fibers of the present invention are typically stretched with a stretch ratio of about 2.5:1–4.5:1, and preferably about 3.0:1–4.0:1, resulting in an appropriate fineness, i.e. about 1–7 dtex, typically about 1.5–5 dtex, preferably about 1.7–3.3 dtex, and more preferably about 1.7–2.2 dtex, as explained above.

The fibers are preferably crimped, typically in a so-called stuffer box, in order to make them easier to process into the fluff pulp due to a higher fiber-to-fiber friction. The bundles of filaments are led by a pair of pressure rollers into a chamber in the stuffer box, where they become crimped due to the pressure that results from the fact that they are not drawn forward inside the chamber. The degree of crimping can be controlled by the pressure of the rollers prior to the stuffer box, the pressure and temperature in the chamber and the thickness of the bundle of filaments. As an alternative, the filaments can be air-textured by passing them through a nozzle by means of a jet air stream.

The crimped fibers are then preferably annealed in order to reduce tensions which may be present after the stretching and crimping processes, and they should in addition be dried. Annealing and drying may take place simultaneously, typically by leading the bundles of filaments from the stuffer box, e.g. via a conveyer belt, through a hot-air oven. The temperature of the oven will depend on the composition of the bicomponent fibers, but must obviously be well below the melting point of the sheath component.

The annealed and dried bundles of filaments are then led to a cutter, where the fibers are cut to the desired length. Cutting is typically accomplished by passing the fibers over a wheel containing radially placed knives. The fibers are pressed against the knives by pressure from rollers, and are thus cut to the desired length, which is equal to the distance between the knives. As explained above, the fibers of the present invention are cut so as to be relatively long, i.e. 3–24 mm, typically 5–20 mm, preferably 6–18 mm, with specially preferred lengths being about 6 mm and about 12 mm.

As mentioned above, the long thermobondable bicomponent fiber of the present invention is useful in the preparation of fluff, i.e. the fluffy fibrous material used as an absorbent core in the production of hygiene absorbent products such as disposable diapers, sanitary napkins, adult incontinence products, etc. The use of the bicomponent fiber in the preparation of fluff results in absorbent materials with superior characteristics, including, as explained above, improved strength and dimensional stability and more efficient use of the super absorbent polymer, thus making possible the production of thinner and lighter weight products and/or products with improved absorption capacity.

A substantial portion of the fluff pulp used in the preparation of absorbent products is typically comprised of cellulose pulp fibers. As mentioned above, the fluff pulp may also contain additional fibers, e.g. thermobondable synthetic fibers. The cellulose fibers and the synthetic fibers are typically blended together at a pulp plant and subsequently formed into a so-called blend sheet, which is rolled up into a reel and transported to a converting factory, where the actual production of the fluff and the absorbent products takes place. The blend sheet is formed by a "wet-laid" process, in which a wet blend containing cellulose fibers and synthetic fibers is formed into a sheet, which is subsequently led via a conveyer belt to a drier, typically an oven, where it is dried. Fluff blends of fibers may also be produced using a dry process, in which case synthetic fibers from a bale are processed with pulp fibers at the converting factory. However, the wet process which produces the blend sheet is preferable, because the blend sheet can be fed in reel form directly into a hammer mill at the converting factory, thus making the converting process less complicated.

The absorbent material containing the long thermobondable bicomponent fibers, as described above, may be produced as follows:

subjecting the bicomponent fibers and non-bicomponent fibers to blending, through dispersion in water, in a fluff pulp production process, so as to obtain a fluff pulp blend in which the bicomponent fibers are distributed in a substantially random and homogeneous manner, forming the wet blend of bicomponent and non-bicomponent fibers into a blend sheet, drying the blend sheet and winding it into a reel, defibrating the dried fluff pulp.

forming the fluff into a mat, optionally, incorporating a super absorbent polymer into the fluff mat, and thermobonding the low melting sheath component of the bicomponent fibers in the material.

The non-bicomponent fibers in the fluff can comprise a variety of different types of natural and/or synthetic fibers, according to the particular absorbent material to be produced. Natural cellulose fibers for use in the preparation of the fluff will typically comprise bleached grades of CTMP (chemi-thermo-mechanical-pulp), sulphite pulp or kraft pulp.

The weight ratio of the bicomponent fibers to the non-bicomponent fibers in the fluff is preferably in the range of about 1:99–80:20. It is necessary that the fluff contain a certain minimum amount of the bicomponent fibers in order that the improved characteristics due to the supporting structure of the thermobonded bicomponent fibers can be achieved. Thus, a bicomponent fiber content of about 1% is regarded as being the necessary minimum. On the other hand, the bicomponent fibers of the present invention need not necessarily constitute a large portion of the fluff. In fact, one of the advantages of these fibers is that they can be used in a reduced amount, compared to the amount typically used in products comprising other currently available thermobondable synthetic fibers. The weight ratio of the bicomponent fibers to the non-bicomponent fibers in the fluff will therefore typically be about 3:97–50:50, preferably about 5:95–20:80, more preferably about 5:95–15:85, and especially about 5:95–8:92.

The bicomponent fibers, having been made permanently substantially hydrophilic, can easily be distributed in a random and substantially homogeneous manner in the wet fluff pulp, as explained above.

It is possible that during the wet process in which the fluff pulp is mixed, a certain amount of the surface active agent may in certain cases be removed from the surface of the bicomponent synthetic fibers. However, it is not believed that this will result in a permanent reduction of the hydrophilic properties of the fibers, since it is believed that the surface active agent, which is also present in the interior of the sheath component of the fibers, will subsequently migrate outwards to the surface of the fibers within a short time, typically within about 24 hours, thereby restoring the fibers' hydrophilic properties.

The wet fluff pulp is then transferred to a mesh, forming a blend sheet, which is led to a drier, typically an oven, and dried, using a temperature that is significantly below the melting point of the sheath component of the bicomponent fibers. The blend sheet is typically dried to a water content of about 6–9%. The blend sheet, which typically weighs about 550–750 g/m$^2$, and more typically about 650 g/m$^2$, is then rolled up, and the reel is then normally transported to the converting factory, where the remaining steps in the production of the absorbent material typically take place.

At the converting factory, the fluff pulp from the reel is typically led to a hammer mill (as illustrated in FIG. 4), for example via a pair of feeding rollers, where the fluff pulp is defibrated. However, defibration may also be accomplished by other methods, for example by using a spike mill, saw-tooth mill or disc refiner. The hammer mill housing encases a series of hammers which are fixed to a rotor. The rotor typically has a diameter of, for example, 800 mm, and typically revolves at a speed of, for example, 3000 rpm. The hammer mill is typically driven by a motor with a power of, for example, 100 kW. Defibration is accomplished as the fibers of the fluff pulp are expelled through the grid holes in the hammer mill. The size of the grid holes depends on the type of fluff being produced, but they will typically be about 10 to 18 mm in diameter. The bicomponent fibers should have a length which is compatible with the size of the grid holes, so that the fibers will survive the defibration in the hammer mill substantially intact. This means that the fibers should not be substantially longer than the diameter of the grid holes.

The defibrated fluff is then formed into a fluff mat in a fluff mat forming hood by suction onto a wire mesh, typically followed by passage through a series of condensing or embossing rollers. The mat is preferably compressed (i.e. either condensed or embossed), but it may also be non-compressed, according to how the absorbent material is to be used. Compression of the mat can alternatively take place either during or after thermobonding.

Prior to thermobonding, a super absorbent polymer, in the form of a powder or small particles, is often incorporated into the material, typically by spraying it into the fluff mat from a nozzle located in the fluff mat forming hood. The purpose of using a super absorbent polymer is to achieve a reduction in the weight and size of the absorbent product, as the amount of fluff in the product can be reduced. The type of super absorbent polymer used is not critical, but it is typically a chemically crosslinked polyacrylic acid salt, preferably a sodium salt or sodium ammonium salt. Such super absorbents are typically able to absorb about 60 times their own weight in urine, blood or other body fluids, or about 200 times their own weight in pure water. They also have the additional advantage that they form a gel upon wetting, thus enabling the absorbent product to more effectively retain the absorbed liquid under pressure. As explained above, the super absorbent polymer is fixed in the desired position in the absorbent material, due to the stable matrix structure formed by the bicomponent fibers upon thermobonding. A more efficient use of the super absorbent polymer is thus achieved, and conglomerations of the super absorbent, which can lead to barriers caused by the gel which forms upon wetting and swelling, are avoided.

One gram of super absorbent polymer can typically replace about five grams of pulp fiber (e.g. cellulose fiber) in the absorbent material. The super absorbent polymer is typically incorporated in the amount of about 10 to 70%, preferably about 12 to 40%, more preferably about 12 to 20%, and especially about 15%, based on the weight of the material.

Subsequent to the incorporation of the super absorbent polymer, the mat is thermobonded, e.g. using an air-through oven, infrared heating or ultrasonic bonding, such that the low melting component of the bicomponent fibers melts and fuses with other bicomponent fibers and at least some of the non-bicomponent fibers, while the high melting component of the bicomponent fibers remains substantially intact, forming a supporting three-dimensional matrix in the absorbent material (as illustrated in FIG. 3). In addition to giving the absorbent material the improved characteristics which have already been discussed, this matrix structure also makes it possible to thermoform the absorbent products, for example to obtain channels for liquid distribution or to give the products an anatomical shape.

The thermobonded absorbent material is then typically formed into units suitable for use in the production of hygiene absorbent products such as disposable diapers, sanitary napkins and adult incontinence products, e.g. by water jet cutting. Alternatively, the absorbent material may be formed into such individual units prior to thermobonding. The residual material (outcuts) may subsequently be led back to the hammer mill to be reused in the preparation of fluff.

The present invention will be more fully described in the following, with reference to the accompanying drawings.

Figure 1:
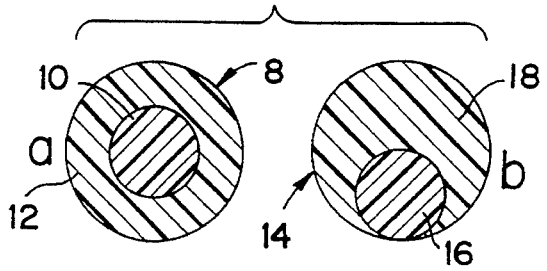
FIG. 1 shows bicomponent fibers in which the components are arranged in a concentric (a) and an acentric (b) configuration.

FIG. 1*a* shows a cross-section of a bicomponent fiber 8 with a concentric configuration. A core component 10 is surrounded by a sheath component 12 with a substantially uniform thickness, resulting in a bicomponent fiber in which the core component 10 is substantially centrally located.

FIG. 1*b* shows a cross-section of a bicomponent fiber 14 with an acentric configuration. A core component 16 is substantially surrounded by a sheath component 18 with a varying thickness, resulting in a bicomponent fiber in which the core component 16 is not centrally located.

Figure 2:
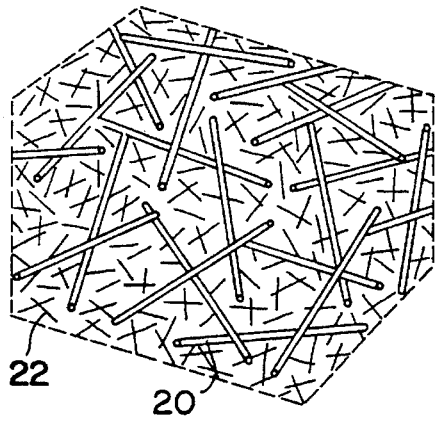
FIG. 2 shows the long bicomponent fibers and the other fibers in the fluff prior to thermobonding.
Figure 3:
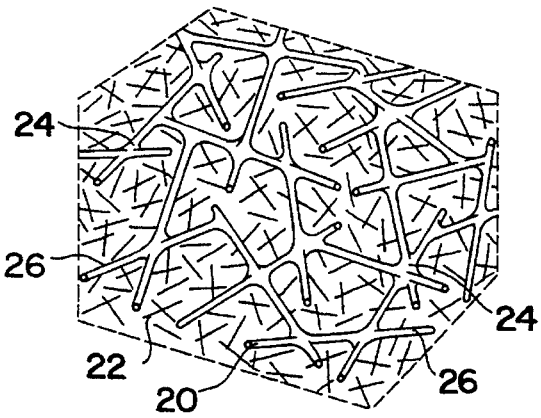
FIG. 3 shows the matrix structure formed by the bicomponent fibers after thermobonding.

FIG. 2 shows the structure of the fluff prior to thermobonding. Bicomponent fibers 20 according to the present invention, comprising a low melting sheath component and a high melting core component, are arranged in a substantially random and homogeneous manner among non-bicomponent fibers 22 in the fluff, FIG. 3 shows the same structure as illustrated in FIG. 2 after thermobonding. The sheath component of the bicomponent fibers has been melted by the thermobonding process, fusing the intact core components together 24, thus forming a supporting three-dimensional matrix. The non-bicomponent fibers 22 are randomly arranged in the spaces defined by the bicomponent fibers. Some of the non-bicomponent fibers 22 have been fused 26 to the bicomponent fibers.

Figure 4:
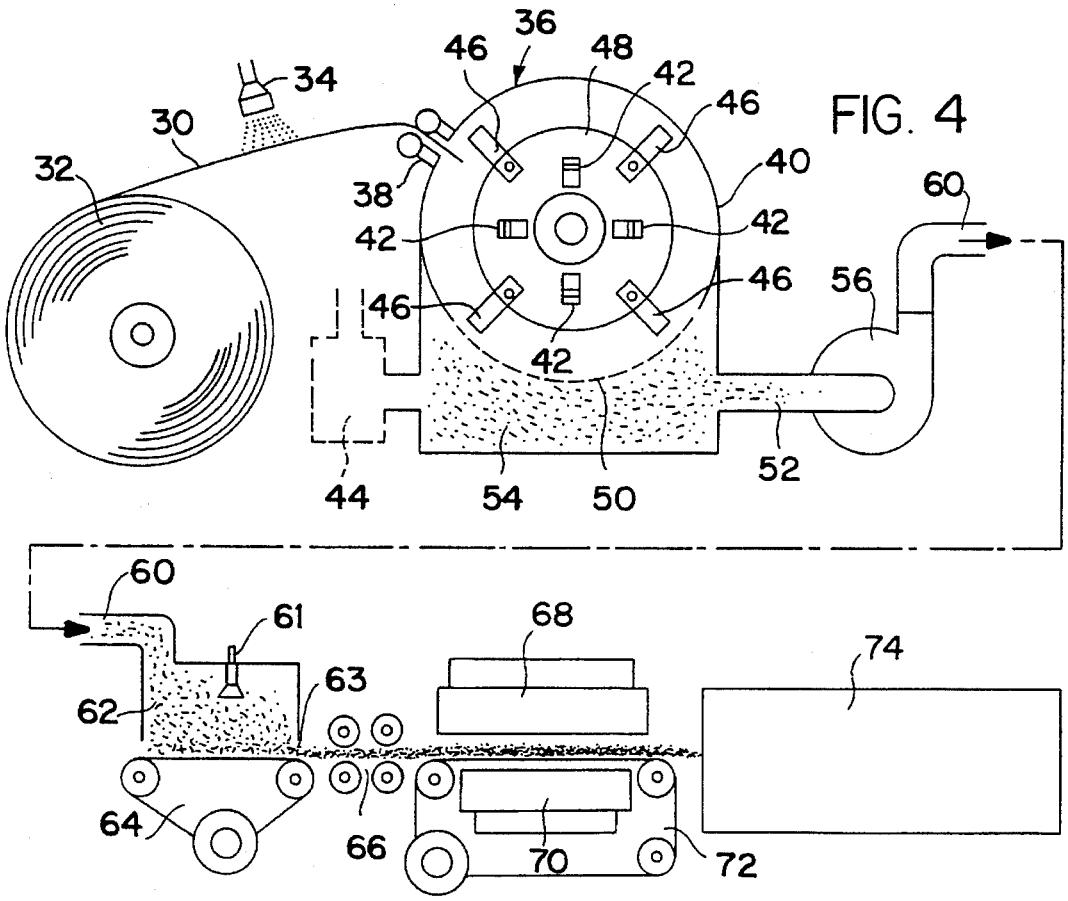
FIG. 4 shows the hammer mill and equipment for producing the absorbent material.

In FIG. 4, fluff pulp 30 from a reel 32 is moistened by water sprayed from a nozzle 34 while being led to a hammer mill 36. The moistened fluff pulp is introduced to the hammer mill 36 via feeding rollers 38. The fluff pulp 30 comprises a mixture of the bicomponent fibers of the present invention and other non-bicomponent fibers. The hammer mill 36 includes a hammer mill housing 40, primary air inlets 42 and a secondary air inlet 44, hammers 46 fixed to a rotor 48, a grid 50 and an outlet 52 for defibrated material 54. A fan 56 leads the defibrated material 54 to a fluff mat forming hood 62 via an exhaust outlet 60. A super absorbent polymer powder is distributed in the fluff mat 63 via a nozzle 61. The fluff mat 63 is led from a wire mesh 64 through condensing or embossing rollers 66 to another wire mesh 72, where the bicomponent fibers are thermobonded by heat treatment in an through-air oven 68, in which hot air is drawn through the material with the aid of a suction box 70. A converting machine 74 is used for the production of hygienic absorbent products from the thermobonded material.

The fluff pulp reel 32, comprising, as explained above, a dried blend of the bicomponent fibers of the present invention and non-bicomponent fibers, is prepared in a pulp plant and transported to a converting factory, where the process illustrated in FIG. 4 takes place. Prior to processing in the hammer mill, the fluff pulp is moistened by a water spray in order to eliminate electrostatic buildup. The fluff pulp reel 32, as obtained from the pulp plant, typically has a diameter of, for example, 1000 mm, a width of, for example, 500 mm and a moisture content of about 6–9%, and the weight of the sheet is typically about 650 g/m$^2$. The fluff pulp is defibrated in the hammer mill 36, in which the rotating hammers 46 expel the fluff through the holes in the grid 50. The rotor 48 which holds the hammers 46 typically has a diameter of, for example, 800 mm and rotates at the rate of, for example, 3000 rpm, driven by a motor with a power of, for example, 100 kW. The grid 50, which is made from a metal sheet with a thickness of about 3 mm, contains holes with a diameter of about 10–18 mm. The length of the bicomponent fibers in the fluff pulp 30 is not substantially greater than the diameter of the holes in the grid 50, so that the bicomponent fibers, as well as the shorter non-bicomponent fibers, are able to pass through the grid 50 holes substantially intact. The defibrated material 54 is then led, with the aid of the fan 56, through the exhaust outlet 60 to the fluff mat forming hood 62, where a fluff mat 63 is formed by suction of the defibrated material 54 onto a wire mesh 64. A super absorbent polymer powder is typically sprayed from a nozzle 61 when half of the fluff mat 63 is formed, so that the super absorbent polymer powder lies substantially in the center of the fluff mat 63. The fluff mat 63 typically passes through a series of rollers 66, in which the mat 63 is condensed or embossed prior to the thermobonding process. The mat 63 is then led via the second wire mesh 72 past the through-air oven 68, which thermobonds the material, thus producing the supporting structure formed by the core component of the bicomponent fibers, as shown in FIG. 3. The thermobonded material is then led to the converting machine 74, in which the production of hygiene absorbent products, such as diapers, takes place.

The invention is further illustrated by the following non-limiting examples.

EXAMPLE 1

Preparation of a permanently hydrophilic, thermobondable, bicomponent synthetic fiber Preparation of the fiber comprised the following steps:

incorporating a surface active agent into the polyethylene sheath component, subjecting the two components of the fiber to a sheath-and-core type conventional melt spinning, resulting in an as-spun bundle of filaments, stretching the as-spun bundle of filaments, crimping the stretched bundle of filaments, annealing and drying the stretched bundle of filaments, and cutting the fibers.

The sheath component of the bicomponent fiber consisted of polyethylene (LLDPE-linear low density polyethylene, octene-based) with a melting point of 125° C. and a density of 0.940 g/cm$^3$, while the core component consisted of isotactic polypropylene with a melting point of 160° C. A surface active agent was incorporated into the polyethylene component before spinning by mixing it into the melted polyethylene, thus making the bicomponent fibers permanently hydrophilic, with hydrophilicity being defined as a sinkage time in water of not more than 5 seconds. The surface active agent (Atmer® 685 from ICI, a proprietary non-ionic surfactant blend) was incorporated in the amount of 1%, based on the total weight of the bicomponent fibers, this being the equivalent of 2% of the weight of the polyethylene component, since the ratio of polyethylene to polypropylene in the bicomponent fibers was 50/50. Atmer® 685 is a blend comprising 20% surfactant and 80% polyethylene, with an HLB (hydrophilic-lipophilic balance) value of 5.6 and a viscosity at 25° C. of 170 mPa s.

The polyethylene component was extruded at a temperature of 245° C. and a pressure of 35 bars, while the polypropylene component was extruded at a temperature of 320° C. and a pressure of 55 bars. The two components were subsequently subjected to a sheath-and-core type conventional melt spinning, using a spinning speed of 820 m/min, resulting in an "as-spun" bundle of bicomponent filaments.

Off-line stretching of the filaments was carried out in a two-stage drawing operation, using a combination of hot rollers and a hot air oven, both of which had a temperature of 110° C., with a stretch ratio of 3.6:1. The stretched filaments were then crimped in a stuffer-box crimper. The filaments were annealed in an oven, at a temperature of 115° C., in order to reduce contraction of the fiber during the preparation of absorbent material, and also to obtain a reduction in the fiber's water content (to about 5–10%), and subsequently cut.

The finished bicomponent fibers had a length of about 12 mm, a fineness of about 1.7–2.2 dtex and about 2–4 crimps/cm.

EXAMPLE 2

Preparation of an absorbent material using CTMP fibers and long hydrophilic thermobondable bicomponent synthetic fibers The preparation of the absorbent material comprised the following steps:

mixing CTMP fibers and the bicomponent fibers of the present invention during the wet stage of a fluff pulp production process, drying the fluff pulp, defibrating the fluff pulp, forming the fluff into a fluff cake, and thermobonding the low melting sheath component of the bicomponent fibers.

In a laboratory hydropulper (British disintegrator), bicomponent synthetic fibers (polypropylene core/polyethylene sheath) were blended with CTMP (chemi-thermo-mechanical-pulp) fluff pulp fibers in a ratio of 6%:94% (3 g bicomponent fibers, 47 g CTMP fibers). The bicomponent fibers had a cut length of 12 mm, a fineness of about 1.7–2.2 dtex, and about 2–4 crimps/cm, and were prepared as in Example 1. The CTMP fibers had a length of about 1.8 mm, and a thickness of about 10–70 μm (average.: 30±10 μm). CTMP fibers are produced in a combined chemical and mechanical refining process (as opposed to other pulp fibers which are subjected to a chemical treatment only). The bicomponent fibers, which included a surface active agent that had been incorporated into the polyethylene sheath component, as described in Example 1, were hydrophilic, and therefore easily dispersed in the wet fluff pulp.

Drying of the fluff pulp was carried out in a drying drum at a temperature of 60° C., which is well below the melting point of the low melting component of the bicomponent fibers, for a period of 4 hours. The dried fluff pulp (water content 6–9%) weighed 750 g/m$^2$. In order to eliminate electrostatic buildup, the dried fluff pulp was conditioned overnight at 50% relative humidity and a temperature of 23° C.

Defibration was carried out in a laboratory hammer mill (Type H-01 Laboratory Defibrator, Kamas Industri AB, Sweden) with a 1.12 kW motor, with hammers fixed to a rotor with a diameter of 220 mm which revolved at a speed of about 4500 rpm, and with grid holes with a diameter of 12 mm in a 2 mm thick metal sheet. The fluff was fed into the hammer mill at a rate of 3.5 g/s. The bicomponent and CTMP fibers, neither of which were more than 12 mm long, were both able to pass substantially intact through the grid holes in the hammer mill. The defibration process required an energy consumption of 117 MJ/ton for the blend of CTMP+6% bicomponent fibers, while defibration of CTMP fluff alone required 98 MJ/ton.

The defibrated blend was then formed into a fluff cake with the aid of standard laboratory pad-forming equipment.

The fluff was subsequently thermobonded by treatment in a laboratory hot-air oven at a temperature range of 110°–130° C. (as measured from the air flow immediately after passage through the sample), for a period of 5 sec. During the thermobonding process, the low melting sheath component of the bicomponent fibers melted and fused with other bicomponent fibers and some of the CTMP fibers, while the high melting component of the bicomponent fibers remained intact. The high melting component of the bicomponent fibers formed a supporting three-dimensional matrix in the absorbent material, giving it improved pad integrity (network strength) and shape retention characteristics. The results of measurements of pad integrity are shown in Table 1. The test pad, which was formed in a SCAN-C 33 standard test-piece former, weighed 1 g and had a diameter of 50 mm. The test was performed with an Instron® tensile tester with a PFI measuring apparatus.

TABLE 1

| | | Non-thermobonded | Thermo-bonded |
|---|---|---|---|
| Dry | CTMP | 4,4 N | 5,3 N |
| | + 6% bicomponent fibres | 5,0 N | 14,0 N |
| Wet | CTMP | 4,4 N | 4,3 N |
| | + 6% bicomponent fibres | 5,5 N | 9,1 N |

EXAMPLE 3

Various permanently hydrophilic, thermobondable, bicomponent synthetic fibers were prepared, using substantially the same process as in Example 1. The core component of the fibers consisted of polypropylene as described in Example 1, and the weight ratio of the sheath/core components in the fibers was 50:50. The surface active agent was the same as that employed in Example 1, and was used in the same amount of 1% based on the total weight of the bicomponent fibers. The other characteristics of the fibers were as follows:

| No. | Sheath Composition | Length | Crimping | Fineness |
|---|---|---|---|---|
| 1 | LLDPE | 6 mm | crimped | 2.2 dtex |
| 2 | LLDPE | 12 mm | crimped | 2.2 dtex |
| 3 | LLDPE | 18 mm | crimped | 2.2 dtex |
| 4 | LLDPE | 6 mm | uncrimped | 2.2 dtex |
| 5 | 75% LLDPE 25% EVA* | 12 mm | uncrimped | 3.3 dtex |

*EVA - Ethyl vinyl acetate

EXAMPLE 4

Laboratory tests on test pads comprising various bicomponent synthetic fibers

Fluff samples were prepared following substantially the procedure of Example 2, using the fibers described in Example 3 as the bicomponent synthetic fibers. Fluff samples were prepared comprising 94% by weight of Scandinavian spruce CTMP pulp and 6% by weight of the respective synthetic fibers. In addition, samples containing 3%, 4.5%, 9% and 12% (by weight) of the synthetic fiber were prepared with fibers 1 and 2. As a reference sample, fluff samples were prepared using 100% CTMP pulp.

Blendsheets were prepared by first blending the CTMP fibers and the synthetic fibers in water in a British disintegrator as in Example 2. The blendsheets were subsequently wet pressed to a constant thickness (bulk=1.5 $cm^3/g$) and dried on a drying drum at a temperature of 6O° C. There were no difficulties in the preparation of the blendsheets, even with the longest synthetic fibers. The blendsheets were then defibrated in a Kamas H-101 hammer mill as in Example 2, using a 12 mm screen and a rotation speed of 4500 rpm.

The knot content of the fluff was determined using a SCAN-C 38 knot tester. The longest fibers (sample 3) had a tendency to form bundles in the knot tester, so that the test could not be completed in this case. It was found that the knot content of fluff containing 6% synthetic fibers having a length of 6 mm (samples 1 and 4) was only 1%, while the knot content of fluff containing 6% synthetic fibers having a length of 12 mm (samples 2 and 5) was somewhat higher, 4% and 7%, respectively.

Test pads having a weight of 1 g were formed using a SCAN pad forming apparatus.

Thermobonding was carried out at a temperature of 170° C., as this temperature was found to be suitable in preliminary tests. Heating times of 1, 2 and 4 seconds were initially tested. The I second heating time gave the best overall result, and this time was used for the final tests.

The pad integrity of the test pads was measured as described in Example 2. The results of these measurements are given in Table 2 below, in which the values for network strength are averages based on 10 samples.

TABLE 2

Comparison of test pads prepared with various synthetic fibres

| | | Network Strength (N) | | | |
|---|---|---|---|---|---|
| | Synthetic | Before Thermo-bonding | | After Thermo-bonding | |
| Sample | Fibre % | Dry | Wet | Dry | Wet |
| CTMP | 0 | 3.6 | 5.0 | 3.7 | 5.8 |
| 1 | 3.0 | 3.1 | 5.7 | 8.6 | 6.5 |
| 1 | 4.5 | 3.3 | 5.7 | 10.5 | 7.8 |
| 1 | 6.0 | 3.1 | 5.6 | 14.0 | 8.7 |
| 1 | 9.0 | 3.5 | 5.6 | 13.2 | 9.4 |
| 1 | 12.0 | 3.4 | 5.7 | 20.0 | 11.8 |
| 2 | 3.0 | 3.7 | 6.5 | 10.8 | 7.6 |
| 2 | 4.5 | 3.6 | 6.3 | 11.4 | 8.8 |
| 2 | 6.0 | 3.7 | 6.3 | 12.0 | 8.9 |
| 2 | 9.0 | 3.8 | 6.1 | 13.8 | 10.1 |
| 2 | 12.0 | 3.8 | 6.5 | 20.0 | 10.8 |
| 3 | 6.0 | 3.5 | 5.3 | 10.4 | 8.7 |
| 4 | 6.0 | 2.9 | 5.3 | 10.2 | 8.0 |
| 5 | 6.0 | 3.1 | 5.1 | 9.9 | 7.4 |

It can be seen from the above table that the dry network strength increased greatly after thermobonding as a result of the incorporation of the bicomponent synthetic fibers according to the invention. Samples 1 and 2 tended to have a slightly better performance in this respect than the others. A comparison of the results for sample 1 (6%) with those for sample 4 shows that crimped fibers are better than uncrimped fibers.

The wet network strength of the test pads was also increased by the incorporation of the synthetic fibers, but the increase was not as great as that of the dry network strength. Samples 1 and 2 tended to provide an improvement in the wet network strength even before thermobonding.

It was thus shown that the incorporation of relatively small amounts of the synthetic bicomponent fibers of the invention provides a considerable increase in the strength of the absorbent pads after thermobonding, as compared to similar pads without the synthetic fibers.

EXAMPLE 5

Bicomponent synthetic fibers according to the invention were prepared as fibers 1 and 2 of Example 3, with the exception that they had a fineness of 1.7 dtex. The fibers were used to prepare test pads in which the cellulose fibers consisted of either Scandinavian spruce CTMP pulp (fluff grade) or bleached, untreated Scandinavian kraft pulp (Stora Fluff UD 14320), using the same procedure as in Example 4. Reference samples containing either 100% CTMP or 100% kraft pulp were also prepared.

The network strength of the test pads was measured as described above. The results are given in Table 3 below, in which the values for network strength are averages based on 10 samples.

TABLE 3

Comparison of test pads with different pulp types and synthetic fibres of different lengths

| Pulp Blend | Synthetic fibre Length | Synthetic fibre % | Network Strength (N) Before Thermo-bonding Dry | Before Thermo-bonding Wet | After Thermo-bonding Dry | After Thermo-bonding Wet |
|---|---|---|---|---|---|---|
| CTMP | — | 0 | 3.4 | 5.2 | 4.4 | 5.1 |
| CTMP | 6 mm | 3.0 | 3.6 | 5.8 | 7.8 | 5.8 |
| | | 4.5 | 3.7 | 5.5 | 9.3 | 6.5 |
| | | 6.0 | 3.8 | 5.8 | 11.6 | 6.3 |
| | | 9.0 | 3.5 | 6.1 | 11.4 | 8.2 |
| | | 12.0 | 3.7 | 6.0 | 20.0 | 9.8 |
| CTMP | 12 mm | 3.0 | 4.1 | 5.2 | 9.4 | 7.1 |
| | | 4.5 | 3.8 | 5.9 | 9.7 | 8.4 |
| | | 6.0 | 4.2 | 6.2 | 10.7 | 7.6 |
| | | 9.0 | 4.0 | 6.0 | 12.3 | 8.9 |
| | | 12.0 | 3.7 | 6.4 | 20.0 | 10.2 |
| Kraft | — | 0 | 4.9 | 5.6 | 5.8 | 5.5 |
| Kraft | 6 mm | 3.0 | 5.2 | 6.0 | 9.1 | 7.9 |
| | | 4.5 | 5.2 | 5.9 | 10.4 | 8.7 |
| | | 6.0 | 5.5 | 5.8 | 10.2 | 8.6 |
| | | 9.0 | 5.7 | 6.2 | 13.2 | 8.5 |
| | | 12.0 | 5.2 | 6.2 | 20.0 | 11.2 |
| Kraft | 12 mm | 3.0 | 5.8 | 6.6 | 9.9 | 8.6 |
| | | 4.5 | 5.8 | 6.9 | 9.9 | 8.6 |
| | | 6.0 | 5.6 | 6.8 | 10.0 | 8.3 |
| | | 9.0 | 5.4 | 6.6 | 17.0 | 9.4 |
| | | 12.0 | 5.4 | 6.5 | 20.0 | 11.3 |

The dry network strength of the kraft test pads was higher than that of the CTMP samples before thermobonding. However, the values were nearly the same after thermobonding. The network strength after thermobonding was significantly increased by incorporation of even small amounts of the synthetic fibers, and was approximately doubled by the addition of 6% synthetic fibers, as compared to the reference test pads comprising only CTMP or kraft pulp fibers.

The wet network strength of the kraft test pads was somewhat higher than that of the CTMP test pads both before and after thermobonding. Both the 12 mm and 6 mm synthetic fibers gave an improvement in wet network strength in both CTMP and kraft pulp pads after thermobonding. The difference in wet strength between pads having synthetic fiber levels of between 3 and 9% was rather small in all cases.

By comparing the results of the measurements of network strength for the CTMP pads in this example with the results from samples 1 and 2 in Example 4 above, it can be seen that a somewhat higher network strength was achieved in most cases by using the slightly thicker synthetic fibers of Example 4, which had a fineness of 2.2 dtex.

We claim:

1. A thermobondable, hydrophilic bicomponent synthetic fiber for use in the blending of fluff pulp, comprising an inner core component and an outer sheath component, wherein (1) the core component comprises a polyolefin or a polyester, (2) the sheath component comprises a polyolefin, and (3) the core component has a higher melting point than the sheath component, wherein the fiber is permanently substantially hydrophilic due to the incorporation into the sheath component of a surface active agent and wherein said fiber has a length of 3–24 mm and a fineness of about 1–7 dtex.

2. The bicomponent synthetic fiber according to claim 1 which has a length of 5–20 mm.

3. The bicomponent synthetic fiber according to claim 2 which has a length of 6–18 mm.

4. The bicomponent synthetic fiber according to claim 3 which has a length of about 6 mm.

5. The bicomponent synthetic fiber according to claim 3 which has a length of about 12 mm.

6. The bicomponent synthetic fiber according to claim 1 wherein the surface active agent has been incorporated into the sheath component in the amount of about 0.1–5%, based on the total weight of the fiber.

7. The bicomponent synthetic fiber according to claim 1 wherein the melting point of the core component is at least 150° C. and that of the sheath component is 140° C. or lower.

8. The bicomponent synthetic fiber according to claim 1 wherein the melting point of the core component is at least 210° C. and that of the sheath component is 170° C. or lower.

9. The bicomponent synthetic fiber according to claim 1 wherein the sheath component polyolefin is selected from the group consisting of high density polyethylene, low density polyethylene, linear low density polyethylene, polypropylene, poly(1-butene) and copolymers and mixtures thereof.

10. The bicomponent synthetic fiber according to claim 1 wherein the core component comprises a polyolefin selected from the group consisting of polypropylene and poly(4-methyl-1-pentene), or a polyester selected from the group consisting of poly(ethylene-terephtalate), poly(butylene-terephtalate), poly(1,4-cyclohexylene-dimethylene-terephtalate), and copolymers and mixtures thereof.

11. The bicomponent synthetic fiber according to claim 1 wherein the core (a) and sheath (b) components, respectively, comprise:

(1) (a) polypropylene and (b) high density polyethylene, low density polyethylene, linear low density polyethylene, polypropylene, or poly(1-butene); or (2) (a) poly(4-methyl-1-pentene) or a polyester and (b) polypropylene, high density polyethylene, low density polyethylene, linear low density polyethylene, polypropylene, or poly(1-butene).

12. The bicomponent synthetic fiber according to claim 1 which has been texturized to a level of from about 0 to 10 crimps/cm.

13. A process for producing thermobondable, hydrophilic sheath-and-core type bicomponent synthetic fibers for use in the blending of fluff pulp, the fibers having a sheath component comprising a polyolefin and a core component comprising a polyolefin or a polyester, the core component having a higher melting point than the sheath component, and having a fineness of about 1–7 dtex, comprising (1) melting the constituents of the core and sheath components, (2) incorporating a surface active agent into the sheath component, (3) spinning the low melting sheath component and the high melting core component into a spun bundle of bicomponent filaments, (4) stretching the bundle of filaments, (5) drying and fixing the fibers, and (6) cutting the fibers to a length of 3–24 mm.

14. The process according to claim 13 wherein the fibers are cut to a length of 5–20 mm.

15. The process according to claim 14 wherein the fibers are cut to a length of 6–18 mm.

16. The process according to claim 15 wherein the fibers are cut to a length of about 6 mm.

17. The process according to claim 15 wherein the fibers are cut to a length of about 12 mm.

18. The process according to claim 13 wherein the surface active agent is incorporated into the sheath component in the amount of about 0.1–5%.

19. The process according to claim 13 wherein the melting point of the core component is at least 150° C. and that of the sheath component is 140° C. or lower.

20. The process according to claim 13 wherein the melting point of the core component is at least 210° C. and that of the sheath component is 170° C. or lower.

21. The process according to claim 13 wherein the sheath component polyolefin is selected from the group consisting of high density polyethylene, low density polyethylene, linear low density polyethylene, polypropylene, poly(1-butene), and copolymers and mixtures thereof.

22. The process according to claim 13 wherein the core component comprises a polyolefin selected from the group consisting of polypropylene and poly(4-methyl-1-pentene), or a polyester selected from the group consisting of poly-(ethylene-terephtalate), poly(butylene-terephtalate), poly(1, 4-cyclohexylene-dimethylene-terephtalate), and copolymers and mixtures thereof.

23. The process according to claim 13 wherein the core (a) and sheath (b) components, respectively, comprise:

(1) (a) polypropylene and (b) high density polyethylene, low density polyethylene, linear low density polyethylene, polypropylene, or poly(1-butene); or (2) (a) poly(4-methyl-1-pentene) or a polyester and (b) either polypropylene, high density polyethylene, low density polyethylene, linear low density polyethylene, polypropylene or poly(1-butene).

24. The process according to claim 13 wherein the stretch ratio is about 2.5:1–4.5:1.

25. The process according to claim 13 wherein the fibers are texturized to a level of about 0–10 crimps/cm.

26. The bicomponent synthetic fiber of claim 6, wherein the surface active agent has been incorporated into the sheath in the amount of about 0.5–2% based on total weight of fiber.

27. The bicomponent synthetic fiber of claim 1, with a fineness of about 1.5–5 dtex.

28. The bicomponent synthetic fiber of claim 1, with a fineness of about 1.7–3.3 dtex.

29. The bicomponent synthetic fiber of claim 1, with a fineness of about 1.7–2.2 dtex.

30. The bicomponent synthetic fiber according to claim 1 which has been texturized to a level of from about 0 to 4 crimps/cm.

31. The bicomponent synthetic fiber of claim 1, wherein the surface active agent is an emulsifier, surfactant, or detergent.

32. The bicomponent synthetic fiber of claim 31, wherein the surface active agent is selected from the group consisting of a fatty acid ester of glycerol, a fatty acid amide, a polyglycol ester, a polyethoxylated amide, a nonionic surfactant, a cationic surfactant, and blends thereof.

33. The process of claim 13, wherein the surface active agent is an emulsifier, surfactant, or detergent.

34. The process of claim 33, wherein the surface active agent is selected from the group consisting of a fatty acid ester of glycerol, a fatty acid amide, a polyglycol ester, a polyethoxylated amide, a nonionic surfactant, a cationic surfactant, and blends thereof.

35. The process of claim 18, wherein the surface active agent is incorporated into the sheath in an amount of 0.5–2% based on the total weight of fiber.

36. The process of claim 24, wherein the stretch ratio is about 3.0:1–4.0:1.

37. The process of claim 1, wherein the fibers are stretched to a fineness of about 1.5–5 dtex.

38. The process of claim 37, wherein the fibers are stretched to a fineness of about 1.7–3.3 dtex.

39. The process of claim 38, wherein the fibers are stretched to a fineness of about 1.7–2.2 dtex.

40. The process of claim 25, wherein the fibers are texturized to a level of about 0–4 crimps/cm.

* * * * *